United States Patent [19]

Samuel et al.

[11] 4,124,001

[45] Nov. 7, 1978

[54] ELECTRONIC SPEED CONTROL FOR A VARIABLE SPEED FAN DRIVE

[75] Inventors: Alan J. Samuel, San Jose; Alan M. Loss, Oakland; Hans H. Cremer, San Jose, all of Calif.

[73] Assignee: FMC Corporation, San Jose, Calif.

[21] Appl. No.: 701,392

[22] Filed: Jun. 30, 1976

[51] Int. Cl.[2] ..... F01P 7/02

[52] U.S. Cl. ..... 123/41.12; 236/35

[58] Field of Search ..... 123/41.05, 41.11, 41.12, 123/32 EB, 148 E; 236/35

[56] References Cited

U.S. PATENT DOCUMENTS

| | | | |
|---|---|---|---|
| 2,403,917 | 7/1976 | Gille | 123/41.05 |
| 2,819,703 | 1/1958 | Suttle | 236/35 |
| 3,266,471 | 8/1966 | Masuuka | 236/35 |
| 3,377,623 | 4/1968 | Costa et al. | 236/35 |
| 3,898,894 | 8/1975 | Aono et al. | 123/148 E |
| 3,908,622 | 9/1975 | Long | 123/148 E |
| 3,942,486 | 3/1976 | Kirchner | 123/41.12 |
| 4,036,432 | 7/1977 | George | 236/35 |

FOREIGN PATENT DOCUMENTS

| | | | |
|---|---|---|---|
| 2,237,979 | 2/1974 | Fed. Rep. of Germany | 236/35 |

*Primary Examiner*—Charles J. Myhre
*Assistant Examiner*—Raymond A. Nelli
*Attorney, Agent, or Firm*—R. S. Kelly; L. B. Guernsey

[57] ABSTRACT

An electronic speed control system for controlling the drive speed of a cooling fan for a motor vehicle. The system includes a temperature sensor to monitor the temperature of the motor coolant to be cooled by the fan. The sensor develops a signal which is proportional to the temperature of the coolant which signal is amplified and modified by an electronic control unit to provide a speed control signal. A rotatable drive unit is coupled to the vehicle drive motor and rotates at a speed which is proportional to the vehicle drive motor's speed. A variable coupler is connected between the drive unit and the cooling fan and is controlled by the speed control signal in order to regulate the speed of the fan and thereby control the temperature of the coolant. The electronic control unit includes means for monitoring the speed of the fan and for limiting the maximum speed of the fan.

11 Claims, 3 Drawing Figures

ELECTRONIC SPEED CONTROL FOR A VARIABLE SPEED FAN DRIVE

The invention herein described was made in the course of or under a contract with the Department of the Army.

BACKGROUND OF THE INVENTION

1. Field of the Invention

The present invention pertains to means for controlling the coolant temperature in a motor vehicle, and more particularly, it pertains to a system that senses the temperature of the coolant supplied to the radiator of a motor vehicle and varies the speed of the radiator cooling fan in accordance with said temperature.

2. Description of the Prior Art

Motor vehicles use rotating fans to move air through the fins of a radiator in order to cool the liquid therein which is used to maintain the motor temperature below a predetermined value. Power to rotate the fan is usually coupled from the vehicle drive motor, by means of a belt and a pair of pulleys, so that the fan speed is proportional to the motor speed.

Modern vehicle motors are designed to operate most efficiently between a predetermined low value of temperature and a predetermined high value of temperature, so it is desirable that the cooling fan be disconnected when the temperature of the cooling liquid is below the predetermined low value. Also, the operation of the cooling fan requires a significant amount of horsepower, so it is desirable that the fan be turned off when it is not needed.

To increase efficiency, some present day motor vehicles utilize a clutch between a drive pulley and the cooling fan so that the fan will be disconnected and will not provide cooling until the motor temperature reaches a predetermined value. A temperature sensitive element, such as a wax pellet, may be used to activate and deactivate the clutch and thereby couple and decouple the fan to the drive motor. In these prior art vehicles the fan is usually completely decoupled from the drive motor when the motor temperature is below a predetermined value. When the motor temperature reaches said predetermined value the fan is directly connected to the drive motor so that the fan rotates at a speed proportional to that of the drive motor while the temperature remains above this predetermined value. During colder weather the fan may cause the radiator temperature to drop rather rapidly so that the fan is continually being turned on and then turned off thereby keeping the motor coolant temperature within a narrow temperature range.

Some of the prior art fan speed control systems utilize the temperature sensitive element to actually modulate the fan speed by controlling a variable drive coupling to the fan. Such prior art fan speed control systems provide temperature responsive speed control over a relatively narrow temperature range, however, due to the inherent limitations of the mechanical control element. For example, a change of 10 degrees of coolant temperature may cause the fan to go from off to full speed. These prior art controls also exhibit quite a large hysteresis band. That is to say, the fan may turn on at a given temperature and turn off at a temperature several degrees below the turn-on temperature. Furthermore, these prior art cooling fan control systems do not have any means for readily adjusting the range of temperatures over which they may operate, and they are nonlinear and generally erratic in operation.

SUMMARY OF THE INVENTION

The electronic speed control system of the present invention uses a temperature sensitive detector which is positioned to sense the temperature of the liquid coolant which is being cooled by the fan with the detector developing an electric signal having a value which is proportional to the temperature of the coolant. A fan drive supplies power to rotate the fan with the speed of the fan drive being controlled by the electrical signals which are generated by the temperature sensitive detector. Thus, the speed of the fan can be controlled directly in a linear relationship with the temperature of the coolant within predetermined and readily adjustable temperature limits.

A feature of the present invention is that the maximum speed of the cooling fan can be readily limited merely by monitoring the fan speed and using such information to alter the electrical signal developed by the temperature sensitive detector.

DESCRIPTION OF THE PREFERRED EMBODIMENT

Figure 1:
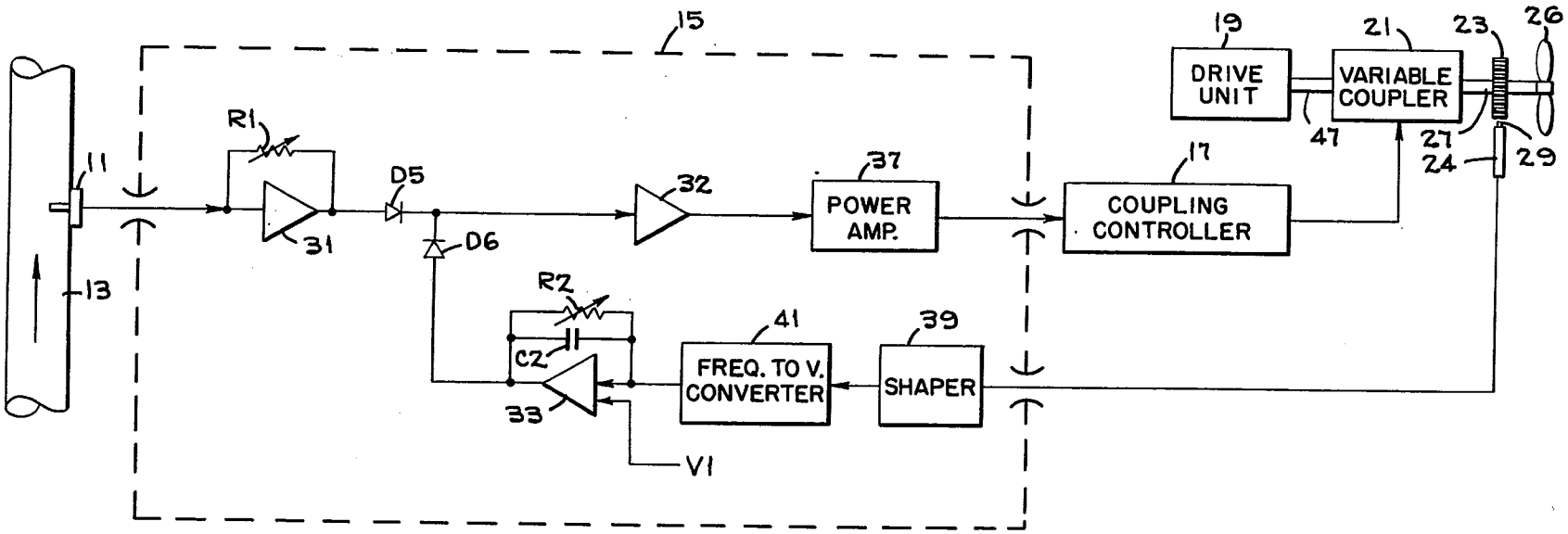
FIG. 1 is a basic block diagram representation of the electronic speed control system of the present invention.

Referring now more particularly to the drawings, FIG. 1 is a block diagram representation of the basic electronic speed control system of the present invention. The speed control system includes a temperature sensor 11 which is mounted (as, for example, on a radiator water hose) to sense the temperature of the coolant 13 for cooling the drive motor of a vehicle. The sensor provides an electrical signal having a value which is determined by the temperature of the coolant. The electrical signal from the temperature sensor 11 is coupled to an electronic control unit 15 which amplifies the signal and couples the amplified electrical signal to a coupling controller 17. The coupling controller and a variable coupler 21 control the amount of coupling between a drive unit 19 and a fan 26 to thereby control the speed of the fan. The fan, of course, directs an air blast against the radiator to lower the temperature of the coolant. The drive unit 19 may be coupled to the vehicle motor by suitable pulleys and a drive belt (not shown). The vehicle motor causes the drive unit 19 to rotate at a speed which is directly proportional to the speed of the motor. The coupling controller 17 provides a temperature responsive signal to the variable coupler 21 in response to the amplified electrical signal. The temperature responsive signal, in turn, causes the coupler 21 to vary the amount of coupling from the drive unit 19 to a shaft 27 so that the speed of the fan is directly determined by the value of the temperature of the coolant as sensed by sensor 11.

Mounted upon shaft 27 is a gear 23. Mounted near the gear 23 is a magnetic pickup 24 which develops a signal having a value which is directly proportional to the speed of the rotating gear 23. This signal from the pickup 24 is coupled to the electronic control unit 15 and is used to limit the maximum speed at which the fan 26 can be rotated.

The magnetic pickup 24 includes a permanent magnet 29 that has one end mounted adjacent the rotating gear 23. Surrounding the permanent magnet is a coil (not shown) which develops a signal when the gear is rotated. As each of the teeth of the gear approaches the end of the permanent magnet the value of the reluctance in the magnetic path between said one end of the permanent magnet and the other end of the permanent magnet is reduced thereby increasing the flux density of the magnetic field around the permanent magnet. When the tooth moves away from said one end of the permanent magnet the amount of reluctance between the ends of the magnet increases thereby causing the value of the flux to decrease. This increasing and decreasing of the flux causes an electrical signal to be generated in the pickup coil surrounding the permanent magnet. The signal developed in the coil is coupled to the electronic control unit 15 to provide a feedback signal which limits the speed of rotation of the fan drive shaft 27. Details of the operation of this type of magnetic pickup may be found in the textbook "Physics" by Hausmann and Slack, published by Van Nostrand Company, New York, N.Y., 1948.

The signals which are developed by the magnetic pickup 24 are coupled to a shaper 39 where they are converted into a train of square pulses of equal duration and applied to a frequency-to-voltage converter 41. The frequency-to-voltage converter provides an output voltage having an amplitude which is directly proportional to the frequency of the pulses applied to the input of the converter. The voltage from the converter 41 is applied to the input of an operational amplifier 33 which provides a speed signal to an amplifier 32 whenever the voltage to the amplifier 33 exceeds a predetermined value of voltage V1. The speed signal is amplified by amplifier 32 and is used to provide a limit to the maximum speed of the fan 26.

As long as the fan 26 is rotating below a predetermined speed the frequency of the pulses developed by the magnetic pickup 24 will be low enough so that the voltage from the converter 41 will not generate a voltage out of the differential amplifier 33. As long as this input voltage from converter 41 is less than the predetermined switching voltage V1 the voltage output of the amplifier 33 will have a value of zero so that only the signal provided by amplifier 31 will be supplied to amplifier 32. This control signal is amplified by amplifier 37 and is applied to the coupling controller 17.

Figure 3:
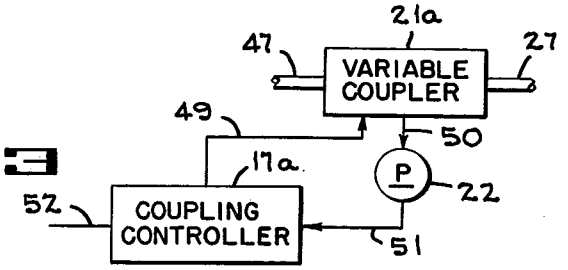
FIG. 3 is a block diagram illustration of one form of apparatus for controlling the coupling between the drive unit and the fan as shown in FIG. 1.

One type of variable coupler 21 and controller 17 combination which may be used in the speed control system of FIG. 1 is illustrated in FIG. 3. The variable coupler **21*a* may be a variable fill fluid coupling of the type disclosed in U.S. Pat. No. 3,862,541. This coupler includes a pair of rotatable impellers with one impeller being connected to the input shaft 47 from the drive unit 19 and the other impeller being connected to the output shaft 27. A hydraulic fluid in the area between the impellers causes the output impeller to rotate as the input impeller rotates. The amount of "slippage" between the input impeller and the output impeller is determined by the amount of oil or other hydraulic fluid between the impellers. The input shaft rotates at a speed which is determined by the drive unit 19 (FIG. 1) so that the speed of the output shaft 27 is determined by the speed of the input shaft 47 and the amount of fluid supplied to an input line 49. When a small amount of fluid is provided to the input line 49 there is a large amount of slippage between the input shaft 47 and the output shaft 27 so that the speed of the shaft 27 is relatively low. When a larger amount of fluid is provided to the input line 49 the slippage is smaller and the speed of the output shaft 27 approaches the speed of the input shaft 47**.

The coupling controller **17*a* (FIG. 3) includes a valve which, in response to an electrical current applied to a coil in the controller, controls the amount of hydraulic fluid which flows through the controller. The controller coil is connected to an input lead 52. A hydraulic fluid input line 51 is connected to a source of fluid such as a pump 22 which receives a supply of oil from a coupler output line 50. A control signal on input lead 52 controls the rate at which fluid from the pump 22 is supplied through the valve mechanism of the controller 17*a*. One such controller 17*a*** which may be used is the FEMA controller Model No. 82230, built by the FEMA Corporation, Portage, Mich.

As long as the fan speed is below the maximum predetermined value, the fan speed will be determined solely by the temperature of the coolant and the speed of the drive unit 19 and will not depend upon the fact that the temperature is rising or falling. Thus, the control system of the present invention does not have hysteresis as does the aforementioned prior art mechanical control systems.

Another type of variable coupler 21 which may be used with the control system of the present invention is a variable clutch having a pair of discs connected to a controller element that varies the coupling between the discs by varying the pressure which presses the discs together.

Figure 2:
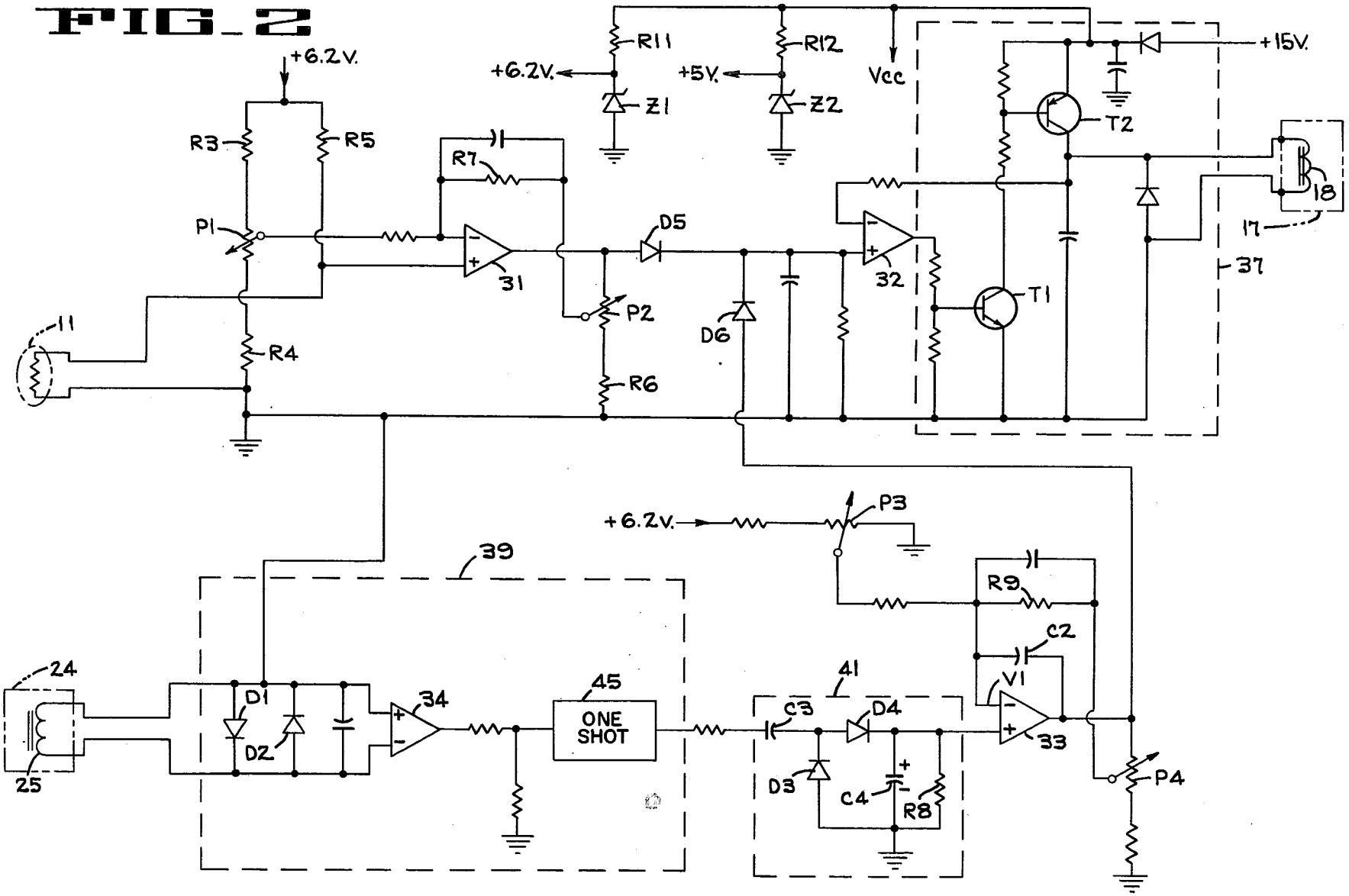
FIG. 2 is a diagrammatic representation of the circuitry of the present invention.

Details of the electronic control unit 15 are shown in FIG. 2. A potentiometer P1, a plurality of resistors R3–R5 and the temperature sensor 11 comprise a bridge circuit with the voltage across the sensor being applied to the non-inverting input of an amplifier 31 and with the voltage across R4 and a portion of the potentiometer P1 being applied to the inverting input of the amplifier. The setting of the potentiometer P1 determines the value of bias voltage which is applied to the amplifier 31 and thereby determines the temperature range which will be utilized by the electronic control unit for controlling the fan speed. This temperature range can be quickly and easily changed by merely changing the setting of the potentiometer P1. The resistance of the sensor 11 is inversely proportional to the temperature of the coolant surrounding the sensor. The voltage which is developed across the sensor is directly proportional to the value of the sensor resistance. One sensor which may be used with the circuit of FIG. 2 is the UU51J1 thermistor made by Fenwal electronics, Framingham, Massachusetts.

The DC voltage across the temperature sensor is amplified by the amplifier 31 and coupled through a diode D5 to the non-inverting input of amplifier 32. The gain of the amplifier 31 is determined by the setting of a potentiometer P2 and the size of a feedback resistor R7 which are connected in series between the inverting input and the output of the amplifier. When the arm of the potentiometer P2 is moved to one end of the potentiometer the value of the voltage fed from the output of the amplifier 31 to the input thereof will be low so that the amplifier gain will be relatively high, and when the amplifier gain is high a small change in coolant temperature provides a relatively large change in fan speed. If a smaller change in fan speed per degree of change of coolant temperature is desired the arm of the potentiometer may be moved toward the other end of the potentiometer. The DC signal which is produced at the output of amplifier 31 is further amplified by amplifiers 32 and 37 and applied to a coil 18 of the coupling controller 17 as shown.

The power amplifier 37 includes a pair of power transistors T1 and T2 which amplify the current that is provided by amplifier 32. The transistor T1 amplifies the relatively small value of current from amplifier 32 and applies the amplified current to the input of transistor T2. Transistor T2 further amplifies the current to provide sufficient current to energize the coil 18 of the coupling controller 17.

The coupling controller 17*a* allows a maximum amount of hydraulic fluid to flow when the current to coil 18 has a value of zero. Thus, if the controller or the electronic control unit 15 should fail so that the coil 18 receives no current, the fan 26 would operate at a maximum speed, such speed being substantially the same as the speed of the input shaft 47 from the drive unit 19.

When the vehicle motor is cold the resistance of the sensor 11 is relatively large so that the voltage across the sensor is large. The voltage across the sensor is amplified to provide a relatively large signal to amplifier 32, which provides a large signal to transistor T1. The signal from transistor T1 causes transistor T2 to provide a large value of current to the coil 18 thereby causing controller 17*a* to cut off the flow of hydraulic fluid to the coupler 21*a* so that the fan 26 is off or rotates at a very low speed.

When the motor coolant temperature increases the resistance of sensor 11 decreases so that the voltage to amplifier 31 decreases. This causes the voltage to amplifier 32 to decrease and thereby decrease the current to coil 18. Under such conditions more hydraulic fluid flows through the controller valve to increase the coupling between the input shaft 47 and the output shaft 27 of the coupler 21*a*—thus increasing fan speed.

A coil 25 of the magnetic pickup 24 (FIG. 2) provides a signal voltage to the input leads of the signal shaper 39 as previously pointed out. The signal voltage from the pickup 24 has a very irregular shape so that it is necessary to reshape the alternating signal into squared pulses in order to provide a useful signal to the frequency-to-voltage converter 41. The reshaping in circuitry 39 is done by a pair of diodes D1 and D2, an amplifier 34, and a one-shot circuit 45. The signal voltage from the coil 25 is clipped by the diodes and amplified by amplifier 34 to provide a series of positive signals which successively trigger the one-shot. The one-shot provides a series of pulses with each pulse corresponding to the signal developed by a single tooth of the gear 23 moving past the pickup 24. Thus, when the gear 23 (FIG. 1) is rotating at a slow speed the space between the pulses provided by the one-shot is considerably larger than the width of the pulses themselves. Whenever the speed of the rotating gear increases the distance between the pulses from the one-shot decreases.

The pulses from the shaper 39 are coupled to the frequency-to-voltage converter 41 to provide an output voltage which is directly porportional to the frequency of the pulses applied to the input. The frequency-to-voltage converter 41 is a conventional voltage doubler circuit and includes a resistor R8 connected across the output. When a signal is applied to the input of the frequency-to-voltage converter 41 a capacitor C3 is charged with a negative voltage on the left plate (FIG. 4) and a positive voltage on the right plate. Pulses provided by the one-shot 45 add to the voltage across capacitor C3 causing a current to flow through a diode D4 and to charge up a capacitor C4 with a positive voltage on the upper plate. During the time between pulses, the charge on the capacitor C4 causes a current to flow from the upper plate of the capacitor through the resistor R8 to the lower plate thereby reducing the electrical charge on the capacitor C4. When the frequency of the pulses applied to the input of the frequency-to-voltage converter increases the time between pulses decreases. This causes the capacitor to charge for a greater percentage of the cycle time so that the steady state value of the voltage across this capacitor increases thereby providing a larger value of voltage at the input of amplifier 33.

A +6.2 volt supply and a potentiometer P3 provide the positive bias voltage V1 to the inverting input of amplifier 33 which causes the output voltage to have a value of zero until the voltage on the non-inverting input of the amplifier 33 exceeds voltage V1. When the voltage from the output of converter 41 exceeds the voltage on the inverting input of amplifier 33 the voltage at the output of the amplifier 33 becomes positive. This positive voltage is coupled through a diode D6 to the non-inverting input of the amplifier 32. This voltage overrides the decreasing voltage from diode D5 and causes amplifiers 32 and 37 to provide a current to the coil 18 of the controller 17 which will ultimately reduce the speed of the fan and thereby provide an upper limit for the fan speed. This maximum fan speed is determined by the setting of the potentiometer P3 which sets the trigger voltage of amplifier 33. When the arm of P3 is moved to the left (FIG. 2) the voltage on the inverting input of amplifier 33 is raised so that the speed of the fan will have to increase to a higher value before the voltage from converter 41 will be able to reduce it.

The gain of the amplifier 33 is controlled by the setting of a potentiometer P4 to control the response time of the fan speed feedback signal and thereby control the amount that the fan speed can increase after the amplifier 33 provides a positive output voltage. When the arm of the potentiometer P4 is adjusted in one direction the gain of the amplifier 33 increases so that any positive difference in voltage between the two inputs causes the amplifier 33 to provide a relatively large value of output voltage which will override any signal provided by the sensor 11 and which will therefore cause an immediate reduction in fan speed. By adjusting P4 to reduce the gain of amplifier 33, the fan speed can increase slightly above the speed at which the feedback voltage was cut in.

The Zener diodes Z1 and Z2 and resistors R11 and R12 provide regulated voltages for various portions of the circuit of FIG. 2. It should also be understood that the biasing voltage Vcc and appropriate ground leads are connected to the various amplifiers 31-34.

It can be seen that the electronic speed control system of the present invention will function to monitor the temperature of a motor coolant and use such information to drive a variable speed fan at a speed to keep the vehicle motor operating within a desired temperature range. The speed control system includes means for continuously monitoring the cooling fan speed and for limiting the maximum speed of the fan. The present invention can easily provide control of fan speed over more than a 25° Fahrenheit range with a continuous linear relationship existing between coolant temperature and fan speed. Thus, the system of the present invention provides a much greater range of control than is possible with prior art systems.

Although the best mode contemplated for carrying out the present invention has been herein shown and described, it will be apparent that modification and variation may be made without departing from what is regarded to be the subject matter of the invention.

What is claimed is:

1. An electronic speed control system for a variable speed fan drive for use with a material to be cooled by a fan, said control comprising: a temperature sensitive detector positioned to sense the temperature of the material, said detector having means for developing an electrical signal having a value determined by the temperature of the material; a fan driver coupled to the fan to rotate the fan; means for varying the coupling between the fan and said fan driver in response to said electrical signal to thereby vary the speed of the fan; means for sensing the speed of the fan and for developing a speed signal having a frequency which is determined by the speed of the fan; a frequency converter coupled to receive said speed signal and providing a converted output indicative of fan speed; and means for comparing said converted output with a predetermined reference level and for providing an override signal when said converted output exceeds said predetermined reference level, said override signal being coupled to said coupling varying means for overriding said electrical signal, thereby limiting the maximum speed of the fan.

2. An electronic speed control system as defined in claim 1 wherein said means for varying the coupling includes a variable coupler connected between said fan driver and the fan, and a coupling controller connected to control the operation of said coupler in response to said electrical signal.

3. An electronic speed control system as defined in claim 2 including means for adjusting said predetermined reference level thereby adjusting the maximum speed of the fan.

4. An electronic speed control system as defined in claim 1 wherein said means for varying the coupling includes a variable coupler connected between the fan and said fan driver, an electronic control unit having means for developing a fan control signal in response to said electrical signal and a coupling controller connected to control the operation of said coupler in response to said fan control signal.

5. An electronic speed control system as defined in claim 1 wherein said means for varying the coupling includes means for connecting the fan to said driver for maximum speed when said detector or said means for varying the coupling fails to operate.

6. An electronic speed control system as defined in claim 1 including means for providing a predetermined fan speed when the temperature of the material increases to a predetermined value from a lower value and for providing substantially the same predetermined fan speed when the temperature of the material decreases to said same predetermined value from a higher value.

7. An electronic speed control system as defined in claim 1 including means for controlling the fan speed over at least a 25° Fahrenheit range of temperature with a change in temperature producing a corresponding linear change in fan speed.

8. An electronic speed control system as defined in claim 7 wherein said means for varying the coupling includes means for adjusting the range of temperature and the range of fan speeds over which said control system operates.

9. An electronic speed control system as defined in claim 1 wherein said means for comparing includes means for adjusting said predetermined reference, thereby adjusting the maximum speed of said fan.

10. An electronic speed control system for a cooling fan on a motor vehicle having a coolant to be cooled, said control system comprising: a temperature sensitive detector positioned to sense the temperature of the coolant, said detector having means for developing an electrical signal having a value determined by the coolant temperature; an amplifier receiving said electrical signal and providing a control signal output; means for selecting a bias level for said amplifier; a rotatable drive unit; means for varying the coupling between said drive unit and the fan; means responsive to said control signal output for controlling said coupling varying means and thereby the speed of the fan relative to the speed of said drive unit; whereby said means for selecting the bias level operates to determine the temperature range over which the coolant is controlled, and, means for developing a speed signal having a value which is determined by the speed of the fan, and means connected between said last named means and said means for controlling said coupling varying means to limit the maximum speed of the fan.

11. An electronic control system as defined in claim 10 wherein said means for varying the coupling includes a variable coupler connected between the fan and said drive unit, and a coupling controller connected to control the operation of said coupler directly in response to said control signal output.

* * * * *

UNITED STATES PATENT OFFICE

CERTIFICATE OF CORRECTION

Patent No. 4,124,001 Dated November 7, 1978

Inventor(s) Alan J. Samuel: Alan M. Loss: Hans H. Cremer

It is certified that error appears in the above-identified patent and that said Letters Patent are hereby corrected as shown below:

Column 6, Line 2, "(Fig. 4)" should be --(Fig. 2)--

Signed and Sealed this

*Eighteenth* Day of *December 1979*

[SEAL]

*Attest:*

SIDNEY A. DIAMOND

*Attesting Officer*

*Commissioner of Patents and Trademarks*